US006803510B2

(12) United States Patent
Van Dusen

(10) Patent No.: US 6,803,510 B2
(45) Date of Patent: Oct. 12, 2004

(54) ASYMMETRICAL STRINGED INSTRUMENT BRIDGE

(76) Inventor: Tim Van Dusen, P.O. Box 433, Edgemont, PA (US) 19028

( * ) Notice: Subject to any disclaimer, the term of this patent is extended or adjusted under 35 U.S.C. 154(b) by 58 days.

(21) Appl. No.: 10/307,052

(22) Filed: Nov. 27, 2002

(65) Prior Publication Data

US 2004/0099123 A1 May 27, 2004

(51) Int. Cl.[7] ..... G10D 3/04

(52) U.S. Cl. ..... 84/307; 84/308; 84/309; 84/298; 84/274

(58) Field of Search ..... 84/307, 308, 309, 84/298, 274

(56) References Cited

U.S. PATENT DOCUMENTS 2,446,267 A * 8/1948 Dahn ..... 84/309
3,120,145 A 2/1964 Weinreich
4,023,459 A 5/1977 Strait
4,286,494 A 9/1981 Jaquith
4,354,416 A 10/1982 Strait
4,389,917 A * 6/1983 Tiebout, III ..... 84/309
4,635,523 A * 1/1987 Merchant ..... 84/307
5,325,756 A * 7/1994 Sugden ..... 84/277

* cited by examiner

*Primary Examiner*—Shih-Yung Hsieh
(74) *Attorney, Agent, or Firm*—Gallagher & Dawsey Co., L.P.; Michael J. Gallagher; David J. Dawsey

(57) ABSTRACT

An asymmetrical stringed instrument bridge incorporating, among other elements, an integral member, a string mounting edge, a foot edge, a treble edge, and a bass edge. The asymmetrical stringed instrument bridge is adapted to rest on a belly plate of a violin, or other stringed instrument, and support a plurality of strings. The asymmetrical stringed instrument bridge may include a plurality of tuning recesses along the edges and apertures in the integral member so as enable one to acoustically tune the bridge while taking into account the unique attributes of each string to optimize the energy transfer and movement of the bridge. The plurality of recesses may also form a treble foot, treble leg, bass foot, and bass leg.

20 Claims, 2 Drawing Sheets

ASYMMETRICAL STRINGED INSTRUMENT BRIDGE

TECHNICAL FIELD

The present invention relates to the field of stringed musical instruments; particularly, to an asymmetrical stringed instrument bridge that improves the sound generated by such instruments.

BACKGROUND OF THE INVENTION

Musicians have long-recognized the need for innovations to improve the sound generated from musical instruments. Many musical instruments have remained relatively unchanged in design and quality of sound generated since their advent. Such long-felt needs have been particularly prevalent in the field of stringed instruments and more particularly bowed string instruments such as the violin family, including, but not limited to, the violin, viola, cello, and bass violin.

A violin generally consists of a sounding box having two sound holes and a neck. Four strings extend from the distal end of the neck to a tailpiece. The strings are attached to individual tuning pegs at the distal end of the neck. The tailpiece is attached to the sounding box and secures the strings. The strings are supported near the center of the violin by a bridge. The bridge generally rests on the sound box through two feet known as the bass foot and the treble foot. When properly tuned, the four strings of the violin produce approximately 20 pounds of force straight down through the bridge to the sounding box. A bass bar consisting of a strip of wood is glued to the inside of the sounding box and runs lengthwise below the bass foot of the bridge.

Additionally, a vertical post located inside the sounding box transmits vibrations between the two major surfaces of the sounding box, generally known as the belly plate and the back plate. The bridge is supported by the belly plate, sometimes referred to as the top plate. The vertical post is known as the sound post and is held between the belly plate and back plate by friction. In most violins the sounding post is located approximately 5 to 6 millimeters below the treble foot of the bridge, however this location varies with the type of stringed instrument and the particular construction.

The close proximity of the treble foot to the sound post restricts the motion of the treble foot. Therefore, the bass foot is much easier to move up and down. In other words, the top of the sound box, i.e. the belly plate, is more rigid near the treble foot of the bridge and more elastic near the bass foot of the bridge. Therefore, as a violin string is driven from side to side by a bow, the bridge tends to pivot about the treble foot. The importance of the bridge's pivoting motion in the resulting sound has not been optimized in prior bridge designs.

The importance of the violin bridge has long been recognized. The bridge holds and supports the strings of the instrument and transmits some of the energy of the strings vibrations from the strings to the body of the instrument. Such vibrations then pass to the belly plate through the bass bar and to the back plate through the sound post. The bridge is not fastened to the sounding box in any way and is held in place by the forces exerted on the bridge by the four strings. The transmission and resonant qualities of the bridge determine the tonal qualities and volume of the instrument. Traditionally, violin makers have believed that the transmission and resonant qualities of the bridge play an important role in determining the tonal qualities and volume of the instrument.

Traditionally, bridges have been symmetric in design. Prior art bridges of the traditional style are illustrated in U.S. Pat. No. 3,120,145 to Weinreich, U.S. Pat. No. 4,023,459 to Strait, U.S. Pat. No. 4,286,494 to Jaquith, U.S. Pat. No. 4,354,416 to Strait, and U.S. Pat. No. 4,389,917 to Tiebout. Symmetrical bridge designs do not fully optimize the qualities of the individual strings, as the strings all vibrate at different frequencies and amplitudes. Symmetric bridge designs do not allow for optimization of the various vibrations created by the frequencies of the individual strings to be transferred to the instrument either by way of those vibrations traveling through the bridge, as is the case with the minor vibrations, or by way of actual movement of the bridge, as is the case with the major vibrations, upon it's pivotal point, the treble foot.

While musicians have long "tuned" their bridges by removing wood from various places on the bridge, they have always placed an emphasis on keeping the bridge symmetrical. In fact, U.S. Pat. No. 4,389,917 to Tiebout illustrates that the prior art has emphasized a belief that a symmetrical design with a central pivot point is essential to a bridge's performance. Additionally, the prior art, including the '917 patent, have taught that there must be a minimum distance above the highest opening in a bridge for a violin to work properly.

Accordingly, the art has needed a means for improving the musical qualities of a violin and increasing the power of the instrument by uniquely considering the qualities of each string of the instrument and considering the elasticity of the sound box. Prior art devices have failed to recognize the importance of the actual movement of the bridge as a whole. While some of the prior art devices attempted to improve the state of the art of string instrument bridges, none has achieved an asymmetrical design that considers individual string qualities, improves the transfer of vibrational energy, and optimizes the actual movement of the bridge, that is easy to manufacture and provides the qualities of the present invention. With these capabilities taken into consideration, the instant invention addresses many of the shortcomings of the prior art and offers significant benefits heretofore unavailable. Further, none of the above inventions and patents, taken either singly or in combination, is seen to describe the instant invention as claimed.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. In one of the many preferable configurations, the asymmetrical stringed instrument bridge incorporates, among other elements, an integral member having a centroid, a string mounting edge, a foot edge, a treble edge, and a bass edge. The asymmetrical stringed instrument bridge is adapted to rest on a belly plate of a violin, or other stringed instrument, and support a plurality of strings, including treble and bass strings, and transfer vibrational energy of the plurality of strings to the belly plate.

The asymmetrical stringed instrument bridge of the present invention is unique in that treble edge and the bass edge are asymmetric about the centroid, center of gravity, or any point on the integral member allowing more efficient transfer of the energy from the strings to the violin. The string mounting edge is adapted to releasably receive the plurality of strings. The string mounting edge is important in that it is the only point upon which the strings contact the asymmetrical stringed instrument bridge.

The string mounting edge may be formed with at least one horizontal tuning recess. The at least one horizontal tuning recess allows the asymmetrical stringed instrument bridge to vibrate more at the top of the bridge than traditional bridge designs. In one exemplary embodiment, the string mounting edge is formed to include a horizontal tuning recess between each pair of strings, resulting in a total of three horizontal tuning recesses. The added flexibility near the string mounting edge improves the sound generated and the amount of energy transferred by the asymmetrical stringed instrument bridge, while still allowing the strings to work together. Prior attempts to improve the vibrational qualities of bridges near the string mounting edge have involved thinning out the bridge in the vicinity of the string mounting edge, often resulting in weakened bridges. Each of the at least one horizontal tuning recesses may be formed into a shape that maximizes the transfer of vibrational energy of the neighboring strings and allows control of the influence that one string may have upon another. In other words, the shape of each recess may be unique depending on the location on the string mounting edge, therefore allowing the string mounting edge to be effectively tuned to create preferred predetermined tones. In one preferred embodiment, the at least one horizontal tuning recess will generally extend into the integral member up to approximately fifty percent of the maximum height of the integral member.

The foot edge is adapted to bear on the belly plate. The foot edge may be formed to include at least one mounting tuning recess. In the embodiment wherein at least one mounting tuning recess is formed in the foot edge, the at least one mounting tuning recess may further define a treble foot, having a treble foot length, and a bass foot, having a bass foot length. As with traditional bridges, the bass foot of the present invention generally rests on the belly plate over the bass bar. The present invention allows the treble foot length and the bass foot length to be adjustable to allow for optimum transfer of energy from the bridge to the instrument.

The treble edge is located on the side of the integral member that is closest to the most treble string, by way of example and not limitation, the E-string of the violin. The treble edge may be formed to include at least one treble tuning recess. The at least one treble tuning recess of the present embodiment is characterized by smoothly flowing curves, unlike traditional bridges which include oval side openings and elements commonly known as "hanging wings."

Additionally, the at least one treble tuning recess may by formed to extend substantially into the integral member. In this embodiment, the at least one treble tuning recess has the effect of creating a ledge upon which the most treble string is mounted. This configuration allows more of the vibrational energy of the most treble string to be transferred to the instrument through both the treble foot and the bass foot. The present embodiment most notably substantially increases the transfer of energy through the bass foot when compared to traditional bridges. The increased high frequency energy transferred to the belly plate produces additional desirable overtones.

Further, various embodiments allow the at least one treble tuning recess and the at least one mounting tuning recess to work together in defining a treble leg formed in the integral member. The size and configuration of the at least one mounting tuning recess and the at least one treble tuning recess may establish predetermined characteristics of the treble leg, such as the width, length, and orientation. Such predetermined characteristics may be unique to a specific violin in order to allow the optimum transfer of vibrational energy to the violin. In one particular embodiment the treble leg is generally oriented in the direction of the centroid from the treble foot. Such orientation allows the at least one treble tuning recess to aggressively, yet smoothly, extend into the integral member achieving the desirable effects previously described.

The bass edge is located on the side of the integral member that is closest to the most bass string, by way of example and not limitation, the G-string of the violin. The bass edge may be formed to include at least one bass tuning recess. The at least one bass tuning recess of the present embodiment is characterized by smoothly flowing curves, unlike traditional bridges which include oval side openings and elements commonly known as "hanging wings." Additionally, the at least one bass tuning recess may by formed to extend substantially into the integral member, however the bass tuning recess preferably does not extend into the integral member as far as the treble tuning recess.

Further, various embodiments allow the at least one bass tuning recess and the at least one mounting tuning recess to work together in defining a bass leg formed in the integral member. The size and configuration of the at least one mounting tuning recess and the at least one bass tuning recess may establish predetermined characteristics of the bass leg, such as the width, length, and orientation. Such predetermined characteristics may be unique to a specific violin in order to allow the optimum transfer of vibrational energy to the violin. In one particular embodiment the bass leg is generally oriented orthogonal to the belly plate. This configuration allows a majority of the vibrational energy of the most bass string to be transferred directly through the bass leg, bass foot, and belly plate to the bass bar.

The asymmetrical stringed instrument bridge may include at least one bridge tuning aperture formed in the integral member. The at least one bridge tuning aperture may be configured to take advantage of each string's individual vibrational qualities, rather than take the traditional shape of a heart. The at least one bridge tuning aperture may take advantage of asymmetry in providing yet another means of tuning the asymmetrical stringed instrument bridge.

Various alternate embodiments may include at least one decorative element on any of the edges. Such at least one decorative element may resemble elements of traditional bridges so as to elicit a feeling of familiarity from the user. Similarly, further alternative embodiments include those wherein the integral member is constructed of materials having varying densities. Additionally, the thickness of the integral member may vary throughout to take advantage of the properties of the individual strings.

These variations, modifications, alternatives, and alterations of the various preferred embodiments, arrangements, and configurations may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

DESCRIPTION OF THE INVENTION

The asymmetrical stringed instrument bridge of the instant invention enables a significant advance in the state of the art. The preferred embodiments of the apparatus accomplish this by new and novel arrangements of elements that are configured in unique and novel ways and which demonstrate previously unavailable but preferred and desirable capabilities.

The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 1:
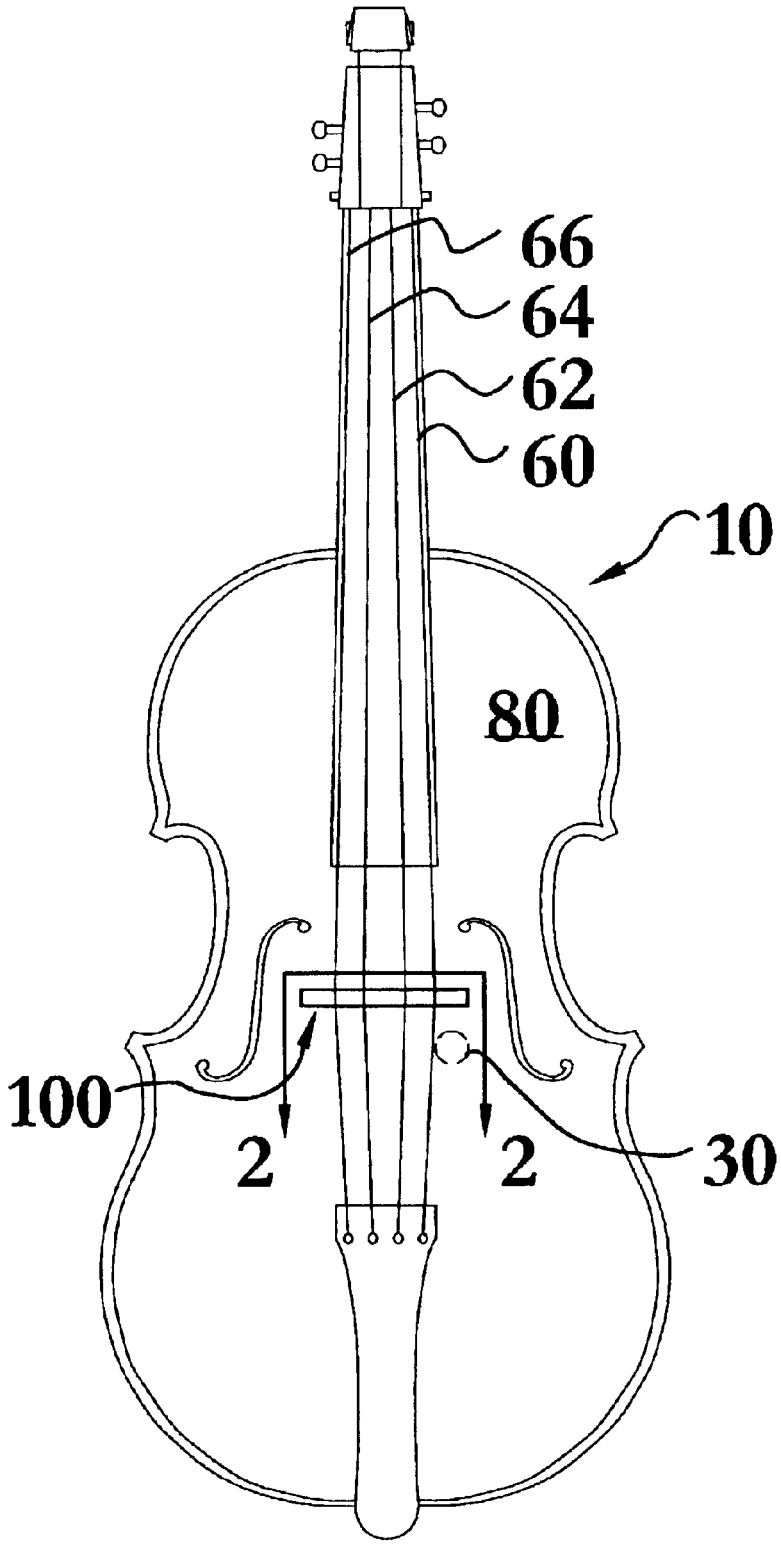
FIG. 1 shows a stringed instrument in top plan view, in reduced scale.
Figure 2:
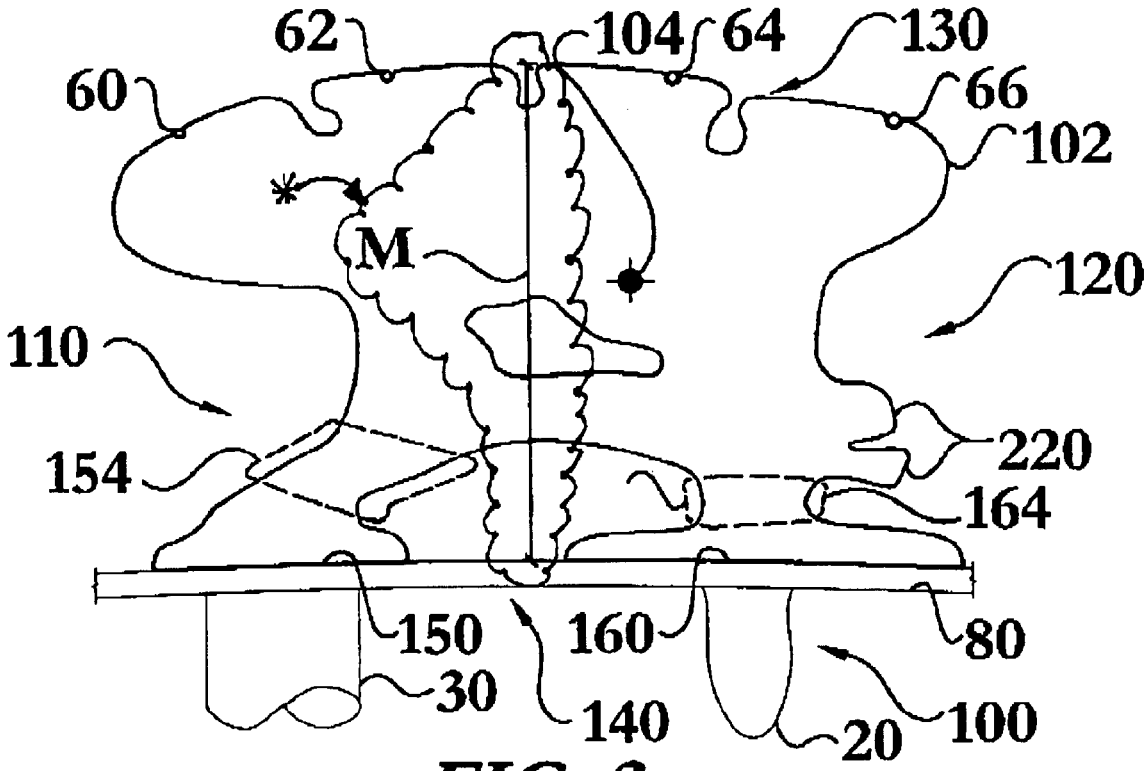
FIG. 2 shows a partial section taken along section lines 2—2 of FIG. 1, illustrating an asymmetrical stringed instrument bridge in front elevation view, in reduced scale.
Figure 3:
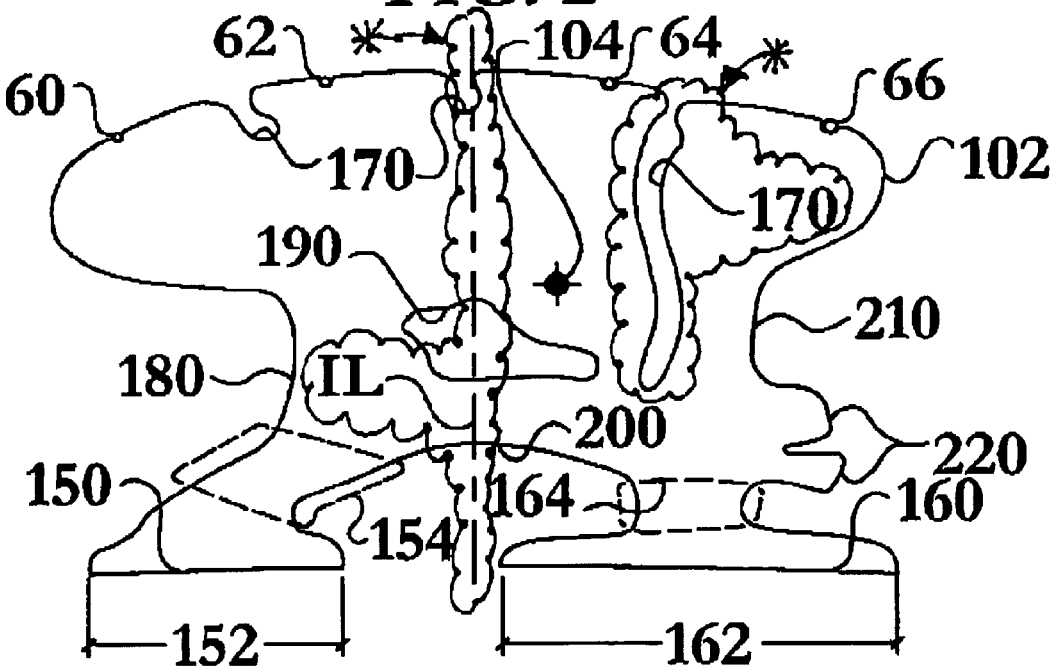
FIG. 3 shows a partial section taken along section lines 2—2 of FIG. 1, illustrating an asymmetrical stringed instrument bridge in front elevation view, in reduced scale.
Figure 2:
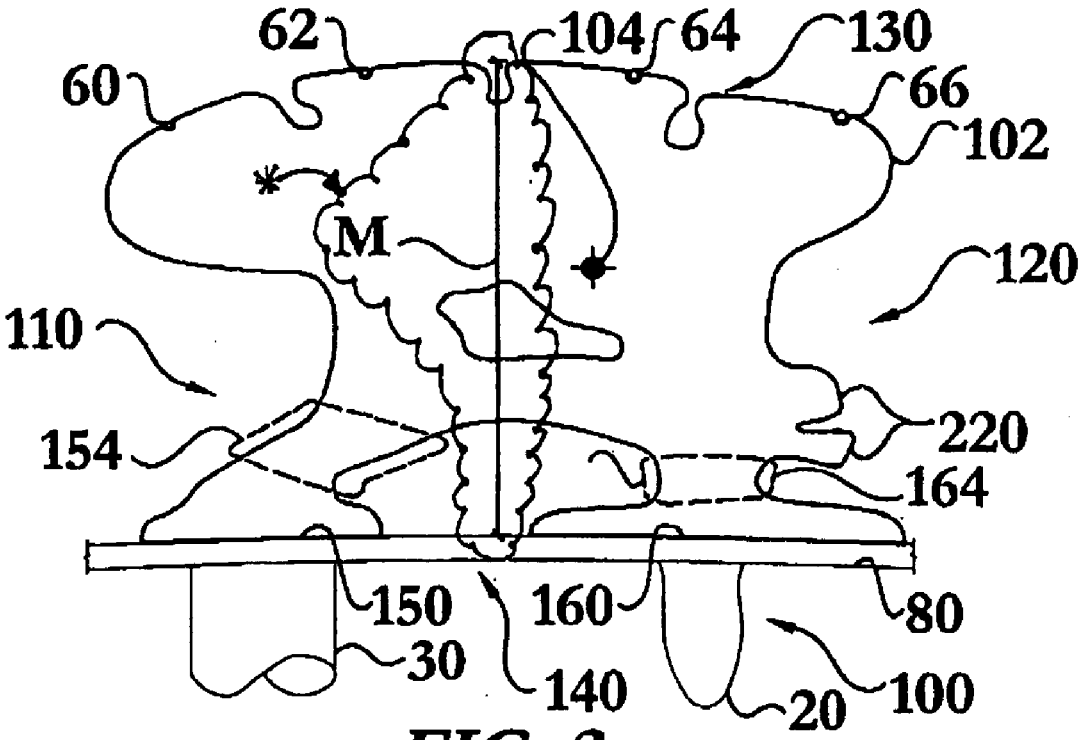
Figure 3:
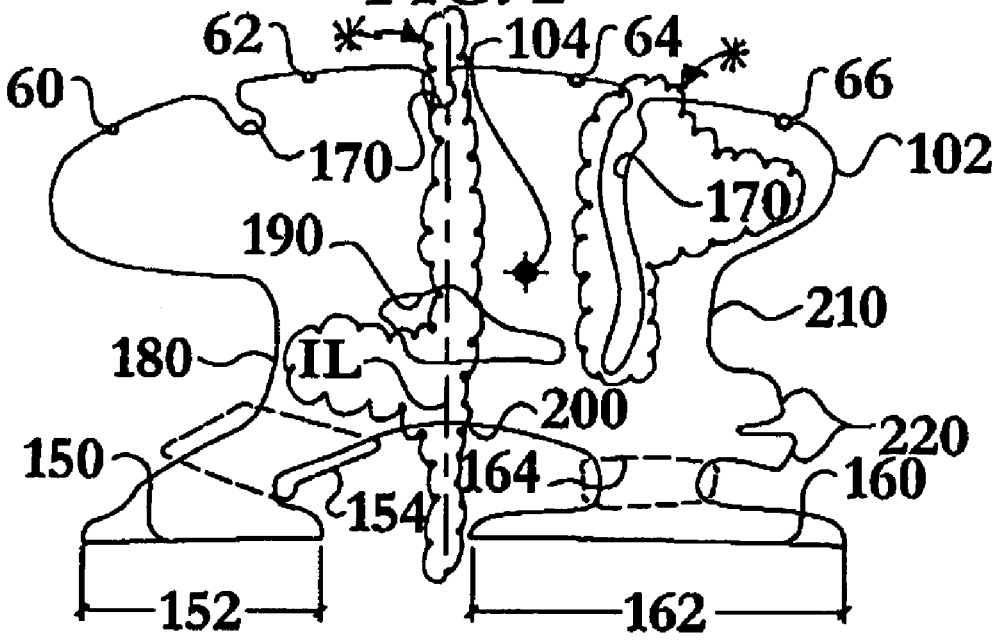

With reference generally now to FIGS. 1 through 3, in one of the many preferable configurations, the asymmetrical stringed instrument bridge 100 incorporates, among other elements, an integral member 102 having a centroid 104, a string mounting edge 130, a foot edge 140, a treble edge 110, and a bass edge 120. The asymmetrical stringed instrument bridge 100 is adapted to rest on a belly plate 80 of a violin 10, or other stringed instrument, and support a plurality of strings and transfer vibrational energy of the plurality of strings to the belly plate 80. The plurality of strings always include a most treble string and a most bass string no matter what stringed instrument utilizes the asymmetrical stringed instrument bridge 100. In the illustrated embodiment, that of the violin, the most treble string is the E-string 60 and the most bass string is the G-string 66, while intermediate strings include the A-string 62 and the D-string 64.

With reference now specifically to FIG. 2 and FIG. 3, the asymmetrical stringed instrument bridge 100 of the present invention is unique in that treble edge 110 and the bass edge 120 are asymmetric. The treble edge 110 and the base edge 120 are asymmetric about an imaginary line IL, seen in FIG. 3, extending from a point equidistant between the most treble spring 60 and the most bass string 66 to the belly plate 80 such that the line IL is substantially perpendicular to the belly plate 80. This asymmetry, particularly the asymmetry in the portions of the treble edge 110 and the bass edge 120 between the centroid 104 and the string mounting edge 130, facilitates more efficient transfer of the energy from the strings 60, 62, 64, 66 to the violin 10. The string mounting edge 130 is adapted to releasably receive the plurality of strings 60, 62, 64, 66. The string mounting edge 130 is important in that it is the only point upon which the stings 60, 62, 64, 66 contact the asymmetrical stringed instrument bridge 100. Additionally, the maximum height of the integral member is labeled as M in FIG. 2.

The string mounting edge 130 may be formed with at least one horizontal tuning recess 170. The at least one horizontal tuning recess 170 allows the asymmetrical stringed instrument bridge 100 to vibrate more at the top of the bridge 100 than traditional bridge designs. In one exemplary embodiment, the string mounting edge 130 is formed to include a horizontal tuning recess 170 between each pair of strings, resulting in a total of three horizontal tuning recesses. The added flexibility near the string mounting edge 130 improves the sound generated and the amount of energy transferred by the asymmetrical stringed instrument bridge 100, while still allowing the strings 60, 62, 64, 66 to work together. Prior attempts to improve the vibrational qualities of bridges near the string mounting edge 130 have involved thinning out the bridge in the vicinity of the string mounting edge 130, often resulting in weakened bridges. Each of the at least one horizontal tuning recesses 170 may be formed into a shape that maximizes the transfer of vibrational energy of the neighboring strings and allows control of the influence that one string may have upon another. In other words, the shape of each recess 170 may be unique depending on the location on the string mounting edge 130, therefore allowing the string mounting edge 130 to be effectively tuned to create preferred predetermined tones. In one preferred embodiment, the at least one horizontal tuning recess 170 will generally extend into the integral member 102 up to approximately fifty percent of the maximum height of the integral member 102.

The foot edge 140 is adapted to bear on the belly plate 80. The foot edge 140 may be formed to include at least one mounting tuning recess 200. In the embodiment wherein at least one mounting tuning recess 200 is formed in the foot edge 140, the at least one mounting tuning recess 200 may further define a treble foot 150, having a treble foot length 152, and a bass foot 160, having a bass foot length 162. The treble foot 150 is substantially in-line with the sound post 30, as shown in FIG. 1 and FIG. 2. As with traditional bridges, the bass foot 162 of the present invention generally rests on the belly plate 80 over the bass bar 20. The present invention allows the treble foot length 152 and the bass foot length 162 to be adjustable to allow for optimum transfer of energy from the bridge 100 to the instrument 10.

The treble edge 110 is located on the side of the integral member 102 that is closest to the most treble string, by way of example and not limitation, the E-string 60 of the violin. The treble edge 110 may be formed to include at least one treble tuning recess 180. The at least one treble tuning recess 180 of the present embodiment is characterized by smoothly flowing curves, unlike traditional bridges which include oval side openings and elements commonly known as "hanging wings."

Additionally, the at least one treble tuning recess 180 may be formed to extend substantially into the integral member 102. In this embodiment, the at least one treble tuning recess 180 has the effect of creating a ledge upon which the most treble string 60 is mounted. This configuration allows more of the vibrational energy of the most treble string 60 to be transferred to the instrument through both the treble foot 150 and the bass foot 160. The present embodiment most notably substantially increases the transfer of energy through the bass foot 160 when compared to traditional bridges. The increased high frequency energy transferred to the belly plate 80 produces additional desirable overtones.

Further, various embodiments allow the at least one treble tuning recess 180 and the at least one mounting tuning recess 200 to work together in defining a treble leg 154 formed in the integral member 102. The size and configuration of the at least one mounting tuning recess 200 and the at least one treble tuning recess 180 may establish predetermined characteristics of the treble leg 154, such as the width, length, and orientation. Such predetermined characteristics may be unique to a specific violin 10 in order to allow the optimum transfer of vibrational energy to the violin 10. In one particular embodiment the treble leg 154 is generally oriented in the direction of the centroid 104 from the treble foot 150. Such orientation allows the at least one treble tuning recess 180 to aggressively, yet smoothly, extend into the integral member 102 achieving the desirable effects previously described.

The bass edge 120 is located on the side of the integral member 102 that is closest to the most bass string, by way of example and not limitation, the G-string 66 of the violin. The bass edge 120 may be formed to include at least one bass tuning recess 210. The at least one bass tuning recess 210 of the present embodiment is characterized by smoothly flowing curves, unlike traditional bridges which include oval side openings and elements commonly known as "hanging wings." Additionally, the at least one bass tuning recess 210 may by formed to extend substantially into the integral member 102, however the bass tuning recess 210 preferably does not extend into the integral member 102 as far as the treble tuning recess 180.

Further, various embodiments allow the at least one bass tuning recess 210 and the at least one mounting tuning recess 200 to work together in defining a bass leg 164 formed in the integral member 102. The size and configuration of the at least one mounting tuning recess 200 and the at least one bass tuning recess 210 may establish predetermined characteristics of the bass leg 164, such as the width, length, and orientation. Such predetermined characteristics may be unique to a specific violin 10 in order to allow the optimum transfer of vibrational energy to the violin 10. In one particular embodiment the bass leg 164 is generally oriented orthogonal to the belly plate 80. This configuration allows a majority of the vibrational energy of the most bass string 66 to be transferred directly through the bass leg 164, bass foot 160, and belly plate 80 to the bass bar 20.

The asymmetrical stringed instrument bridge 100 may include at least one asymmetric bridge tuning aperture 190 formed in the integral member 102. The at least one asymmetric bridge tuning aperture 190 may be configured to take advantage of each string's individual vibrational qualities, rather than take the traditional shape of a heart. The at least one asymmetric bridge tuning aperture 190 may take advantage of asymmetry in providing yet another means of tuning the asymmetrical stringed instrument bridge 100.

Various alternate embodiments may include at least one decorative element 220 on any of the edges 110, 120, 130, 140. Such at least one decorative element 220 may resemble elements of traditional bridges so as to elicit a feeling of familiarity from the user. Similarly, further alternative embodiments include those wherein the integral member 102 is constructed of materials having varying densities. Additionally, the thickness of the integral member 102 may vary throughout to take advantage of the properties of the individual strings.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

I claim:

1. An asymmetrical stringed instrument bridge adapted to rest on a belly plate and support a plurality of strings, including treble and bass strings, and transfer vibrational energy of the plurality of strings to the belly plate, comprising:

an integral member having a centroid, and having (a) a string mounting edge adapted to releasably receive the plurality of strings, (b) a foot edge adapted to bear on the belly plate, (c) a treble edge proximal to the most treble string, and (d) a bass edge proximal to the most bass string, wherein the portion of the treble edge and the bass edge between the centroid and the string mounting edge are formed to be asymmetrical about an imaginary line extending from a point equidistant between the most treble string and the most bass string to the belly plate such that the line is substantially perpendicular to the belly plate.

2. The asymmetrical stringed instrument bridge according to claim 1, wherein the string mounting edge is formed with at least one horizontal tuning recess.

3. The asymmetrical stringed instrument bridge according to claim 1, wherein the foot edge is formed to include at least one mounting tuning recess, further defining a treble foot, having a treble foot length, and a bass foot, having a bass foot length.

4. The asymmetrical stringed instrument bridge according to claim 3, wherein the bass foot length is greater than the treble foot length.

5. The asymmetrical stringed instrument bridge according to claim 1, wherein the treble edge is formed to include at least one treble tuning recess.

6. The asymmetrical stringed instrument bridge according to claim 1, wherein the bass edge is formed to include at least one bass tuning recess.

7. The asymmetrical stringed instrument bridge according to claim 1, wherein the bass edge is formed to include at least one decorative element.

8. The asymmetrical stringed instrument bridge according to claim 1, wherein the integral member is formed to include at least one asymmetric bridge tuning aperture.

9. An asymmetrical stringed instrument bridge adapted to rest on a belly plate and support a plurality of strings, including treble and bass strings, and transfer vibrational energy of the plurality of strings to the belly plate, comprising:

an integral member having a centroid, and having (a) a string mounting edge adapted to releasably receive the plurality of strings, (b) a foot edge adapted to bear on the belly plate, (c) a treble edge proximal to the most treble string, and (d) a bass edge proximal to the most bass string, wherein the portion of the treble edge and the bass edge between the centroid and the string mounting edge are formed to be asymmetrical about an imaginary line extending from a point equidistant between the most treble string and the most bass string to the belly plate such that the line is substantially perpendicular to the belly plate;

at least one mounting tuning recess formed in the foot edge, further defining a treble foot, having a treble foot length, and a bass foot, having a bass foot length; and at least one treble tuning recess formed in the treble edge.

10. The asymmetrical stringed instrument bridge according to claim 9, wherein the at least one treble tuning recess and the at least one mounting tuning recess define a treble leg formed in the integral member, the treble leg being generally oriented in the direction of the centroid from the treble foot.

11. The asymmetrical stringed instrument bridge according to claim 9, wherein the string mounting edge is formed with at least one horizontal tuning recess.

12. The asymmetrical stringed instrument bridge according to claim 9, wherein the bass foot length is greater than the treble foot length.

13. The asymmetrical stringed instrument bridge according to claim 9, wherein the bass edge is formed to include at least one bass tuning recess.

14. The asymmetrical stringed instrument bridge according to claim 13, wherein the at least one bass tuning recess and the at least one mounting tuning recess define a bass leg formed in the integral member, the bass leg being substantially orthogonal to the belly plate.

15. The asymmetrical stringed instrument bridge according to claim 9, wherein the bass edge is formed to include at least one decorative element.

16. The asymmetrical stringed instrument bridge according to claim 9, wherein the integral member is formed to include at least one asymmetric bridge tuning aperture.

17. An asymmetrical stringed instrument bridge adapted to rest on a belly plate and support a plurality of strings, including treble and bass strings, and transfer vibrational energy of the plurality of strings to the belly plate, comprising:

an integral member having a centroid, and having (a) a string mounting edge adapted to releasably receive the plurality of strings, (b) a foot edge adapted to bear on the belly plate, (c) a treble edge proximal to the most treble string, and (d) a bass edge proximal to the most bass string, wherein the portion of the treble edge and the bass edge between the centroid and the string mounting edge are formed to be asymmetrical about an imaginary line extending from a point equidistant between the most treble string and the most base string to the belly plate such that the line is substantially perpendicular to the belly plate;

at least one mounting tuning recess formed in the foot edge, further defining a treble foot, having a treble foot length, and a bass foot, having a bass foot length;

at least one treble tuning recess formed in the treble edge;

at least one bass tuning recess formed in the bass edge;

at least one horizontal tuning recess formed in the string mounting edge;

at least one asymmetric bridge timing aperture formed in the integral member;

a treble leg formed in the integral member by the at least one treble tuning recess and the at least one mounting tuning recess, that is generally oriented in the direction of the centroid from the treble foot; and a bass leg formed in the integral member by the at least one bass tuning recess and the at least one mounting tuning recess, the bass leg being substantially orthogonal to the belly plate.

18. The asymmetrical stringed instrument bridge according to claim 17, wherein the at least one horizontal tuning recess extends into the integral member tip to approximately fifty percent of the maximum height of the integral member.

19. The asymmetrical stringed instrument bridge according to claim 17, wherein the bass foot length is greater than the treble foot length.

20. The asymmetrical stringed instrument bridge according to claim 17, wherein the bass edge is formed to include at least one decorative element.

* * * * *

UNITED STATES PATENT AND TRADEMARK OFFICE

CERTIFICATE OF CORRECTION

PATENT NO. : 6,803,510 B2
APPLICATION NO. : 10/307052
DATED : October 12, 2004
INVENTOR(S) : Tim Van Dusen It is certified that error appears in the above-identified patent and that said Letters Patent is hereby corrected as shown below:

The patent was issued with the incorrect images displayed as figures two and three, and on the patent cover page. The correct drawings can be found on the Patent Application Information Retrieval page under Application Number 10/307,052. The document containing both the edited images (which incorrectly appear on the issued patent) and the finalized images has a Document Description of "Drawings" and a Mail Room Date of June 4, 2004. The edited images appear on page 1 of this document, while the finalized images appear on page 2.

Signed and Sealed this

Twenty-sixth Day of September, 2006

JON W. DUDAS
*Director of the United States Patent and Trademark Office*